United States Patent [19]

Clarke et al.

[11] Patent Number: 4,802,415

[45] Date of Patent: Feb. 7, 1989

[54] TELESCOPED AMMUNITION ROUND HAVING SUBCALIBER PROJECTILE SABOT WITH INTEGRAL PISTON

[75] Inventors: Stephen E. Clarke, Orange; James D. Hendry, Huntington Beach; Ernest R. Mijares, Sunset Beach, all of Calif.

[73] Assignee: Ford Aerospace Corporation, Newport Beach, Calif.

[21] Appl. No.: 138,259

[22] Filed: Dec. 28, 1987

[51] Int. Cl.[4] ..... F42B 5/02

[52] U.S. Cl. ..... 102/434; 102/521

[58] Field of Search ..... 102/430, 433, 434, 520–523, 102/703

[56] References Cited

U.S. PATENT DOCUMENTS

| | | | |
|---|---|---|---|
| 3,482,516 | 12/1969 | Farmer et al. | 102/433 |
| 3,620,167 | 11/1971 | Romer et al. | 102/521 |
| 3,961,580 | 6/1976 | Burnett et al. | 102/520 |
| 4,015,527 | 4/1977 | Evans | 102/433 |
| 4,197,801 | 4/1980 | Lafever et al. . | |
| 4,335,657 | 6/1982 | Bains . | |
| 4,382,411 | 5/1983 | Ambrosini | 102/523 |
| 4,487,131 | 12/1984 | Luther | 102/523 |
| 4,516,502 | 5/1985 | Klein et al. | 102/523 |
| 4,604,954 | 8/1986 | Clarke et al. . | |

FOREIGN PATENT DOCUMENTS

| | | |
|---|---|---|
| 0027552 | 12/1982 | European Pat. Off. . |
| 2038456 | 12/1978 | United Kingdom . |

OTHER PUBLICATIONS

Abstract of 1,256,740 Subcaliber Projectile, 5/27/69 Rheinmetall.

*Primary Examiner*—Harold J. Tudor

*Attorney, Agent, or Firm*—Peter D. McDermott; Roger L. May

[57] ABSTRACT

A telescoped ammunition round comprises:

a propellant charge having an axial cavity for supplying firing power to the ammunition round;

a control tube means housed within the aft end of the axial cavity;

a booster charge within the axial bore of the control tube, fireable in response to a primer means of the ammunition round in communication therewith; and a sabot/projectile assembly mounted within the axial cavity, its aft end extending into the control tube, wherein the sabot comprises an integral piston at its aft end to receive propulsive forces upon firing of the booster charge of the ammunition round.

12 Claims, 2 Drawing Sheets

TELESCOPED AMMUNITION ROUND HAVING SUBCALIBER PROJECTILE SABOT WITH INTEGRAL PISTON

BACKGROUND OF THE INVENTION

1. Technical Field

This invention relates to a telescoped ammunition round comprising a subcaliber projectile and sabot for the projectile. More specifically, the invention is directed to such telescoped ammunition round, wherein the sabot comprises an integral piston at its aft end for launching the projectile upon firing the ammunition round.

2. Background Art

Telescoped ammunition typically includes a propellant charge having an axial bore or cavity, a projectile housed entirely within the axial cavity of the propellant charge and, optionally, a case around the propellant charge. A telescoped round typically also includes a control tube at the aft end of the axial cavity of the propellant charge. A piston is slidably mounted within the control tube so as to be forwardly movable in response to firing of a booster charge. In U.S. Pat. No. 4,604,954 a telescoped ammunition round is shown comprising such control tube piston, wherein the booster charge is packed within a rearwardly opening cavity of the piston itself. A similar arrangement is shown in U.S. Pat. Nos. 4,335,657 and 4,197,801. In each of these cited patents, the forward end of the control tube piston abuts the rear face of the ammunition round projectile. Thus, upon forward motion movement of the piston in response to the firing of the booster charge, the projectile is moved correspondingly forward into the gun barrel bore.

Where a subcaliber projectile is employed, as is usual in the case of armor piercing projectiles, a discarding sabot typically is used to mount the projectile within the axial cavity of the ammunition round. The discarding sabot usually will provide the driving band for the projectile/sabot assembly. Due to the extremely high propulsive forces generated during firing of an ammunition round and the resulting high rates of acceleration, difficulties have been encountered in maintaining good connection between the projectile and the surrounding sabot. Specifically, the force of the piston against the rear face of the projectile has been known to cause the projectile to be forwardly displaced relative the sabot, whereupon the function of the ammunition round is lost or impaired. Also, when neither integral with the projectile nor trapped in the control tube, the control tube piston causes undesirable debris. Telescoped ammunition rounds comprising a sabot-housed projectile in combination with a control tube piston according to known designs are complex both in design, assembly and function, which complexity introduces undesirable costs and quality control issues in the production of such ammunition rounds.

It is an object of the present invention to provide a telescoped ammunition round comprising a sabot mounted subcaliber projectile which, upon firing, produce reduced debris. It is another object of the invention to provide such a telescoped round having improved sabot separation following exit of the projectile from a gun muzzle. It is yet another object to provide an ammunition round which in preferred embodiments allows use of a rifled gun barrel. It is yet another object to provide a telescoped ammunition round which is less complex in design, assembly and function than certain previously known ammunition rounds of this type. These and additional objects of the invention will be better understood from the following disclosure and discussion of the invention.

SUMMARY OF THE INVENTION

According to the present invention, a telescoped ammunition round is provided which comprises:

a propellant charge having an axial cavity for supplying firing power for the ammunition round;

a control tube means housed within the axial cavity of the propellant charge for selectively covering an aft surface portion of the axial cavity, the control tube means having a generally cylindrical axial bore substantially coaxial with the axial cavity of the propellant charge;

a discarding sabot concentric with and extending axially within the axial cavity, having an aft end positioned within the axial bore of the control tube, the sabot comprising at its aft end a piston integral therewith, the piston having a generally cylindrical outer surface forming a sliding fit with the axial bore;

a subcaliber projectile mounted within the discarding sabot;

a booster charge within the axial bore aft of the piston, the sabot being forwardly moveable in response to force against a rearward facing surface of the piston generated during firing of the booster charge and the projectile being forwardly moveable by forward movement of the sabot; and a primer means in communication with the booster charge for actuating a firing of the ammunition round.

DETAILED DESCRIPTION OF THE INVENTION

Figure 1:
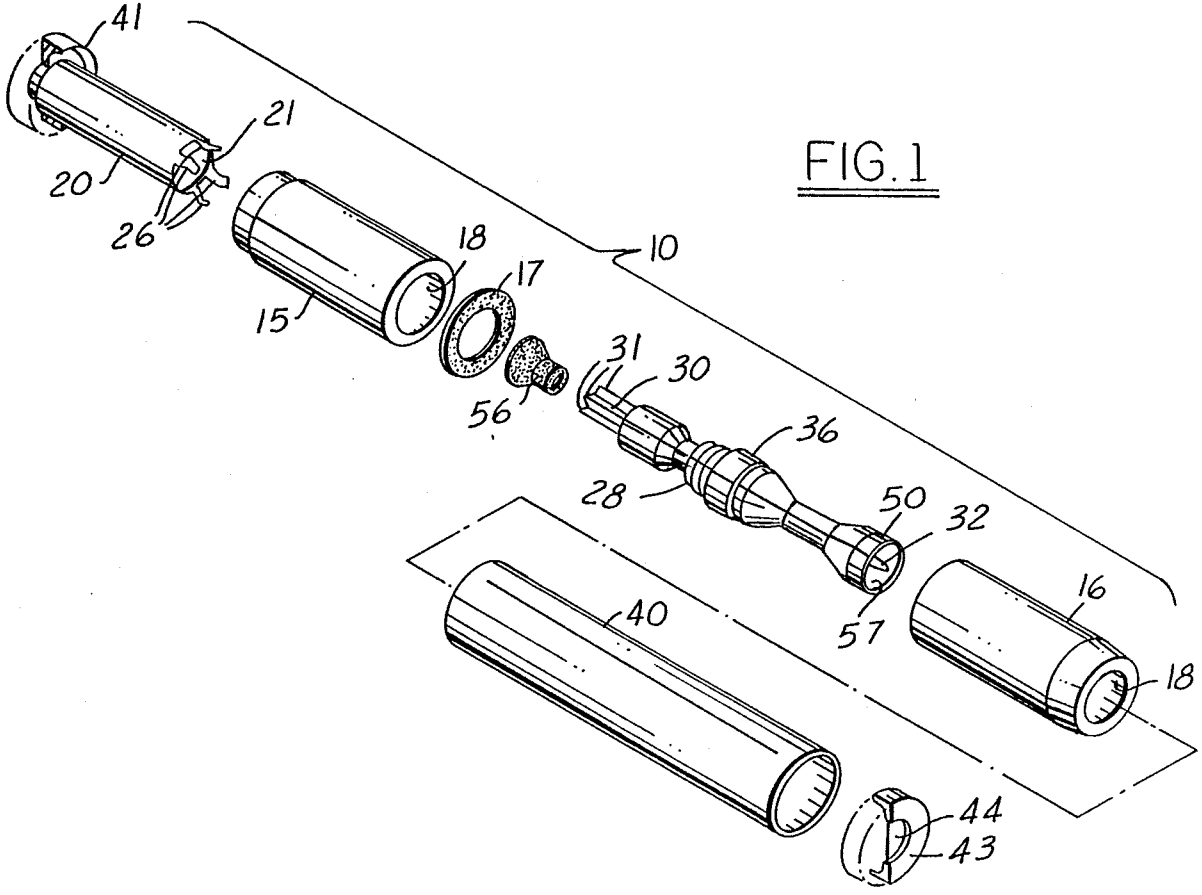
FIG. 1 is an exploded perspective view of a telescoped ammunition round in accordance with an embodiment of this invention.
Figure 2:
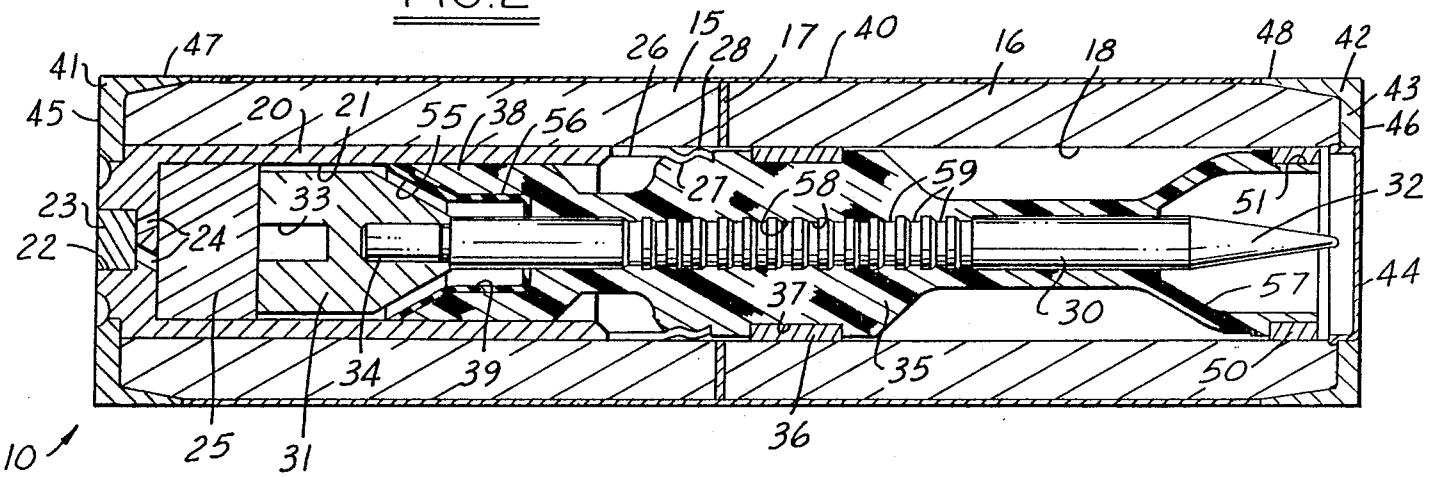
FIG. 2 is a section view of the ammunition round of FIG. 1.

Referring to FIGS. 1 and 2, an ammunition round 10 is seen to comprise a propellant charge formed in two parts, specifically, an aft charge grain 15 and a forward charge grain 16. Optionally, more or less than two charge grains may be used. Optionally, a thermal spacer 17 is included between the forward and aft charge grains. The propellant charge forms an axial cavity 18. A control tube 20 is housed within the aft end of the axial cavity and forms a snug fit against the aft surface portion of the axial cavity. The control tube is cylindrical, forming a generally cylindrical axial bore 21 substantially coaxial with the axial cavity of the propellant charge. In the embodiment depicted, the control tube comprises a primer charge housing 22 in which is packed a primer charge 23. Flash holes 24 provide communication from the primer charge housing to booster charge 25 at the aft end of the axial bore 21 of control tube 20. Optionally, a single central flash hole or other flash hole configuration could be used. A saboted projectile is housed within the telescoped ammunition round. Specifically, subcaliber projectile 30 is mounted within sabot 35 which is disposed within the axial cavity of the propellant charge. The aft end of the sabot/-projectile assembly is positioned within the axial bore 21 of the control tube 20, while the forward end of the assembly is forward of the forward end of the control tube and, in fact, extends approximately to the forward end of the ammunition round. Projectile 30 in the embodiment shown is a fin stabilized armor piercing projectile. It comprises radially outwardly extending longitudinal fins 31 at its aft end and an aerodynamically tapered nose 32 at its forward end. The finned portion of the projectile can be seen to comprise rearwardly opening recess 33 suitable to house a projectile trace or base bleed charge. Such finned portion of the projectile is seen to form a threaded connection with rearwardly extending boom 34. Alternative suitable means for connecting the fins to the projectile body include, for example, a press fit, a welded connection, etc.

The propellant charge 16, 17 is bounded by a cylindrical hollow outer case 40 on the outside cylindrical surface thereof. Optionally, an inner case on the inside cylindrical surface can be provided for the portion of axial cavity 18 forward of control tube 20. The aft end of the ammunition round 10 and the forward end thereof optionally are sealed by an aft seal 41 and a forward seal assembly 42, respectively. Aft seal 41 extends at the rear of the ammunition round from the tubular outer case 40 to the control tube 20. Various suitable means for mechanically attaching the aft seal to the aft end of the control tube and to the outer case are known to the skilled of the art. At the forward end of the ammunition round, front seal assembly 42 comprises end cap 43 and circular sealing disc 44. Again, suitable means for mechanically attaching the front seal assembly are well known to those skilled in the art and will be apparent in view of the present disclosure.

In the preferred embodiment shown in the drawings, the aft end of the ammunition round is seen to be closed by the aft end of control tube 20 mating annularly with the aft seal 41 which, in turn, is fixed to outer tubular case 40. During firing of the ammunition round the rear face 45 of aft seal 41 and the forward face 46 of front end cap 43 seat against the axially rearward and forward ends, respectively, of the ammunition chamber to provide a gas seal. The longitudinally extending flange portions 47 and 48 of the aft seal 41 and forward end cap 43, respectively, maintain contact with tubular case 40. Various designs are known to the skilled of the art for allowing radial expansion of the outer tubular case 40 with substantially no permanent deformation thereof. Substantial permanent deformation of the case might prevent rapid and easy removal of the case from a gun chamber following firing of the ammunition round. One such design calls for a split cartridge case, as disclosed in commonly assigned U.S. Pat. No. 4,604,954, the disclosure of which is incorporated herein by reference. According to one design a continuous tubular case is mechanically processed internally, e.g., by being internally scored, to facilitate resilient radial expansion during firing and contraction of the case thereafter. That is, when the ammunition round 10 is placed in the chamber of a gun, such processing of the cartridge permits it to deflect to sustain the firing pressure without substantial permanent deformation of the case. Since the case is not under radial compression, it is readily removable from the chamber after completion of the ballistic cycle. This feature is particularly applicable to use of an ammunition round in accordance with an embodiment of the invention used in automatic multi-fire telescoped ammunition guns.

The sabot 35 depicted in the preferred embodiments of FIGS. 1 and 2 comprises two or more preferably symmetrical, in fact preferably identical, longitudinal segments held together by driving band 36. In the embodiment of the invention shown, as noted above, the projectile is fin stabilized rather than spin stabilized. Accordingly, ammunition round 10 would be fired through a smooth bore gun barrel rather than a rifled bore gun barrel. However, according to a feature of the invention according to certain preferred embodiments, in order to enable the ammunition round to be used commonly with spin-stabilized ammunition in guns having a rifled bore, driving band 36 may be provided as a slip obturator. In this way, upon being fired through a rifled bore, rotation would be imparted to the slip obturator but little of the rotational forces would be transmitted to the sabot/projectile assembly. The driving band 36 can comprise, for example, a plastic material. One preferred material is a water conditionable, pliable nylon material with memory. Such nylon driving band is water conditioned so as to be sufficiently pliable and stretchable for assembly onto the sabot. Upon reaching driving band well 37, due to its inherent "memory" it returns to its smaller diameter and is thereby retained within driving band well 37. As will be discussed further below, upon exit of the sabot/projectile assembly from a gun muzzle, aerodynamic forces acting on the bell mouth at the front and back of the sabot cause the sabot to separate. The driving band material is selected so as to render the driving band destructible by such separating forces, as is well known to those skilled in the art.

In the embodiment depicted in FIGS. 1 and 2, ammunition round 10 further comprises a bore rider 50 mounted in annular recess 51 at the forward end of sabot 35. Optionally, the bore rider can be deleted and the sabot made full diameter at its forward end.

The sabot/projectile assembly must be secured within the axial cavity of ammunition round 10 sufficiently to withstand the forces incurred during normal handling, storage, etc. In the embodiment depicted in FIGS. 1 and 2, control tube 20 comprises forwardly extending tangs 26. Retention nubbins or undulations 27 at the axially forward end of tangs 26 nest with or are received by corresponding undulations 28 in the outer surface of sabot 35. This arrangement, in addition to supporting the sabot/projectile assembly, provides some resistance to forward movement of the projectile during initial firing of the ammunition round. Releasably securing the sabot/projectile to the control tube provides a so-called "shot start" for the projectile to improve the repeatability of the interior ballistic trajectory Alternative means for coupling the sabot/projectile to the control tube are known to the skilled of the art and include for example that shown in U.S. Pat. No. 4,335,657 to Bains, the disclosure of which is hereby incorporated by reference.

It will be understood by the skilled of the art according to known principles, that the main propellant charge of the ammunition round will be ignited by the hot combustion products of the booster charge as the aft end of piston 38 passes the forward end of control tube 20 at the aft end of tangs 26. Alternatively, firing holes can be provided through the wall of the control tube forward of the aft end of the piston 38. Provision of such firing holes can be provided generally in accordance with the principles disclosed in commonly assigned U.S. Pat. No. 4,197,801, the disclosure of which is herein incorporated by reference.

According to the present invention, the sabot/projectile assembly of the ammunition round comprises an additional, unique feature. Specifically, sabot 35 comprises an integral piston 38 at its aft end. Piston 38 is seen to have a cylindrical outer surface forming a sliding fit within control tube 20. In the embodiment shown, piston 38 is unitary with the remainder of sabot 35. Of course, where the sabot comprises longitudinal segments, as described above, the piston could be correspondingly segmented, each segment integral with, preferably unitary with, the corresponding segment of the forward end of the sabot. Piston 38 is seen to form a rearwardly opening recess 39 adapted to capture the high pressure gaseous combustion products of the booster charge 25 and, subsequently, of the main propellant charge in the ammunition round. In the embodiment depicted in FIGS. 1 and 2, piston 38 is seen to comprise rearward bevelled surface 55 adapted to better ensure a tight sealing fit against the inside surface of control tube 20 under the force of propulsion gases during firing of the ammunition round. It will be appreciated that in addition to serving as a means to capture propulsive forces, piston 38 serves also as a travel guide for the sabot/projectile assembly during the boost phase of firing the ammunition round. Because the piston is integral with the sabot and not the projectile, the sabot, in effect, pulls the projectile down the gun barrel, rather than the reverse. Accordingly, in the embodiment depicted in FIGS. 1 and 2, the sabot comprises a series of annular ridges 58 which seat in corresponding annular grooves 59 extending circumferentially around the shaft of projectile 30. It will be within the skill of the art in view of the present disclosure to select a suitable number and depth of matching grooves/ridges to provide good longitudinal attachment of the sabot to the projectile while allowing good separation of the sabot from the projectile following exit of the sabot/projectile assembly from a gun muzzle. It will likewise be within the skill of the art to employ alternative coupling means.

Where the sabot comprises a plurality of longitudinally divided segments fitted together around the projectile, it is preferred to employ a gas seal boot against the rearward face of the piston. Such gas seal boot prevents escape of propulsion gases forward into the sabot at the parting line of the sabot segments. That is, the gas seal boot provides a low pressure seal of the sabot split line(s). In FIG. 2, gas seal boot 56 is seated against the rearward face of recess 39 formed by piston 38.

It will be appreciated by those skilled in the art in view of the present disclosure that piston 38 performs yet an additional function during the firing of the ammunition round 10. Specifically, as briefly mentioned above, upon exit of the sabot/projectile assembly from a gun muzzle, the piston provides a rearwardly opening recess, a bell mouth responsive to the propulsion gases exiting the gun muzzle behind the sabot/projectile assembly. The propulsive gases act to force the longitudinal segments of the sabot away from the projectile. The large lateral area of the piston produces so-called "lift dominant" sabot separation. Simultaneously, aerodynamic forces acting on the forwardly opening recess, bell mouth 57 at the forward end of the sabot, likewise are separating the sabot segments away from the projectile. The driving band 36 is ruptured by these separating forces an the projectile is freed of the sabot with little or no so-called rod clipping, that is, contact of the sabot with the projectile following separation.

It will be appreciated that the present invention provides significant advantages over subcaliber telescoped ammunition rounds according to previously known designs. Because the propulsive forces act on a piston which is integral with the sabot, the cartridge length can be reduced. Also, the debris of a separate piston is avoided. The lift dominant sabot separation according to preferred embodiments discussed above is found to improve the accuracy of ammunition rounds of the invention over comparable prior designs. Also, the present invention lends itself to good tracer ignition. Specifically, a rearwardly opening recess can be provided at the aft end of the projectile aft of the piston where it will be well exposed to the combustion products of the booster charge and of tee main propellant charge of the ammunition round. Such recess can be seen in the embodiment of FIGS. 1 and 2, specifically, recess 33 is seen at the rearmost end of the projectile.

The above-described components of the ammunition round 10 each can be fabricated using methods and materials well known to the skilled of the art and apparent in view of the present disclosure. Thus, for example, it will be apparent that the control tube should be constructed of high strength materials such as 17-4 PH stainless steel or the like. It also should be understood that the present invention is not limited to materials and fabrication techniques presently known but, rather, includes those applicable to the invention which are developed subsequently hereto.

Figure 3:
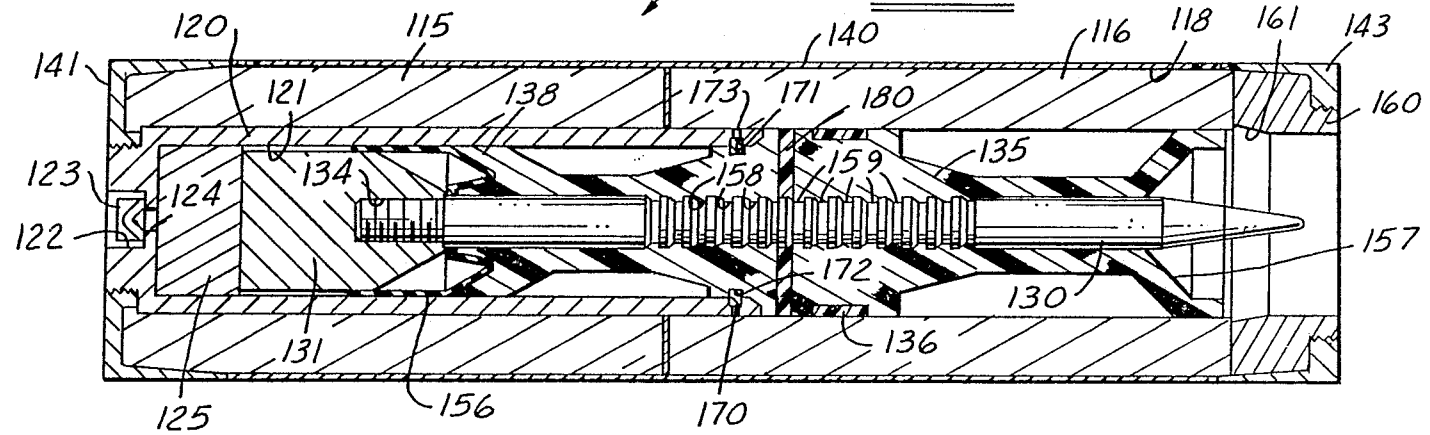
FIG. 3 is a section view of a second embodiment of the invention.

Referring now to FIG. 3, an alternative embodiment of the invention is depicted, wherein ammunition round 100 comprises projectile 130, again a fin stabilized armor piercing type projectile. Projectile 130 is mounted in sabot 135 which is comprised of multiple, preferably two, longitudinal segments held together by the driving band, i.e., by slip obturator 136. The projectile is axially fixed to the sabot by means of a series of annular grooves 159 extending circumferentially around the projectile shaft in which are seated corresponding annular ridges 158 of the sabot. The sabot comprises bell mouth 157 at its forward end and integral piston 138 at its aft end. As in the embodiment of FIGS. 1 and 2, piston 138 forms a generally cylindrical outer surface which forms a sliding fit with the inside surface 121 of control tube 120. A gas seal boot 156 is seated against the rearward lateral face formed by piston 138. It differs somewhat from the gas seal boot design shown in the embodiment of FIGS. 1 and 2, most notably in that it provides a rearwardly extending cylindrical section which overlaps the forward end of fins 131 of the projectile. In this way the gas seal boot 156 acts as a fin protector. As in the embodiment of FIGS. 1 and 2, it also acts as a low pressure gas seal, but here not only does it prevent the flow of gases forwardly of the piston through the parting line of the sabot segments, but also assists in sealing against the passage of combustion gases around the outside of the piston between the piston and the control tube. Control tube 120 comprises primer housing 122 in which a primer charge 123 is positioned. Flash hole 124 provides communication from the primer housing 122 to booster charge 125. Projectile fins 131 are seen to have a threaded connection 134 with the aft end of projectile 130.

The ammunition round of FIG. 3 further comprises an aft end cap 141 having a threaded connection to the aft end of control tube 120. Aft end cap 141 is attached to outer tubular case 140 which, in turn, is attached to forward end cap 143. At the forward end of the ammunition round, end cap 143 has a threaded connection with centering ring 160. Centering ring 160 acts in the nature of a barrel extension and provides bevelled entry surface 161 to guide the sabot/projectile assembly into the barrel of a gun.

Ammunition round 100 is seen to comprise a propellant charge comprising forward charge grain 116 and aft charge grain 115. The propellant charge forms an axial cavity 118 in which the sabot/projectile assembly of the ammunition round is mounted.

In the embodiment of FIG. 3, the sabot/projectile assembly is secured to the control tube 120 by means of a retention ring 170. Specifically, an inwardly facing circumferential groove 171 is provided in the control tube forward of piston 138. An outwardly facing circumferential groove 172 is provided in sabot 130, grooves 171 and 172 being aligned with one another when the control tube and the sabot/projectile are assembled together in the ammunition round. Retention ring 170 is positioned in grooves 171 and 172 and is adapted to shear in response to forward movement of the sabot/projectile assembly as a result of axial pressure applied to the sabot piston 138 during firing of the ammunition round. In this way, the grooves and retention ring arrangement releasably secures the projectile to the control tube. The use of a retention ring will generally be preferred to the tangs 21 in the embodiment of FIGS. 1 and 2, since the force necessary to shear such retention ring is more predictable and controllable and the coupling therefore can be designed more precisely.

The above-described coupling of the sabot/projectile assembly to the control tube, in addition to providing a shot start, provides (together with the additional surface contact between the sabot and the control tube) the necessary structural support for the projectile during handling, storage, etc. The retention ring 170 can be fabricated of any of numerous materials known to the skilled of the art and apparent in view of the present disclosure. A nylon ring, for example, would provide the necessary durability and shearability for this application. According to the embodiment depicted in FIG. 3, firing holes 173 can be provided through the wall of the control tube 120 at spaced locations around circumferential groove 171. It will be apparent to the skilled of the art in view of the present disclosure that the firing holes could be provided elsewhere through the wall of the control tube or, in the alternative, could be deleted. The main propellant charge of ammunition round 100 will, in any event, be exposed to the combustion products of the booster charge once piston 138 and gas seal boot 156 pass forwardly of the forward end of the control tube.

An additional optional feature of the invention is depicted in FIG. 3. Specifically, seal 180 is provided to further reduce the escape of high pressure gases through the sabot. Seal 180 comprises a hole which is drilled through the sabot or otherwise formed during the fabrication of the sabot segments at the parting line between such segments. A resilient sealing material such as a silicon type resilient material is forced into the aperture either during or following assembly of the sabot about the projectile. Some of the resilient material will infiltrate between the sabot segments at the parting line to act as a gas seal.

The telescoped ammunition round according to the embodiment of FIG. 2 will be understood to operate in the same general manner and according to the same general principles discussed in connection with the embodiment of FIGS. 1 and 2. Most significantly, the advantages described above in connection with the embodiment of FIGS. 1 and 2 derive from the piston provided as an integral part of the sabot will be achieved also in connection with the embodiment of FIG. 3.

Various modifications and variations in the particular preferred embodiment depicted above will be apparent to those skilled in the various arts to which this invention pertains in view of the present disclosure. All such variations and modifications are properly considered to be within the scope of this invention as defined by the following claims.

We claim:

1. A telescoped ammunition round comprising:

a propellant charge having an axial cavity for supplying firing power for said ammunition round;

a control tube means housed within said axial cavity for selectively covering an aft surface portion of said axial cavity, said control tube means having a generally cylindrical axial bore substantially coaxial with said axial cavity;

a discarding sabot concentric with and extending axially within said axial cavity, having an aft end within said axial bore, said sabot comprising at its aft end a piston integral therewith, said piston having a generally cylindrical outer surface forming a sliding fit with said axial bore;

a subcaliber projectile mounted within said discarding sabot;

a booster charge mounted within said axial bore aft of said piston, said discarding sabot being forwardly moveable in response to pressure against a rearward facing surface of said piston generated during firing of said booster charge and said projectile being forwardly moveable by forward movement of said discarding sabot; and a primer means in communication with said booster charge for actuating a firing of said ammunition round.

2. The telescoped ammunition round according to claim 1, further comprising a gas seal boot seated against said rearward facing surface of said piston.

3. The telescoped ammunition round according to claim 2, wherein said gas seal boot comprises a cylindrical wall extending axially in contact with said control tube rearwardly of said piston.

4. The telescoped ammunition round according to claim 1, wherein said projectile is a fin stabilized projectile and said sabot comprises a plurality of substantially symmetrical longitudinal segments held together about said projectile by a driving band comprising an obturator forming a sliding fit in a recess extending circumferentially about said sabot.

5. The telescoped ammunition round according to claim 1, wherein said sabot is axially fixed to said projectile by a series of annular grooves extending circumferentially around said projectile, in which series of grooves is received a series of corresponding annular ridges extending circumferentially on said sabot.

6. The telescoped ammunition round according to claim 1, wherein said sabot comprises an annular recess extending circumferentially about a forward end of said sabot, and said ammunition round further comprises a bore rider received in said annular recess.

7. The telescoped ammunition round according to claim 1, wherein said sabot is releasably secured to said control tube by means of tangs integral with said control tube and extending from a forward end thereof, said tangs releasably engaging an exterior surface of said sabot forward of said piston.

8. The telescoped ammunition round according to claim 1, wherein said sabot is releasably secured to said control tube by means of a shearable retention ring seated in an inwardly facing annular recess in said control tube and in an outwardly facing annular recess in said sabot.

9. The telescoped ammunition round according to claim 1, wherein said control tube comprises at least one firing opening providing access to said propellant charge from within said axial bore so that temperature and pressure conditions within said axial bore adjacent said firing opening can cause firing of said propellant charge, each said firing opening being positioned axially forward of said piston.

10. The telescoped ammunition round according to claim 1, further comprising a generally tubular casing means surrounding said propellant charge.

11. The telescoped ammunition round according to claim 1, further comprising a tubular casing means about the exterior of said propellant charge and first and second end cap means for providing a gas seal during firing of said ammunition round in a gun chamber, said first end cap means being seated over the forward end of said tubular casing means and having a central opening for passing said projectile when said ammunition round is fired, and said second end cap means being seated over an aft end of said tubular casing means and cooperating with said control tube means to seal the aft end of said ammunition round.

12. The telescoped ammunition round according to claim 1, wherein said piston forms a rearwardly opening recess.

* * * * *